US005143372A

United States Patent [19]

Wilson

[11] Patent Number: 5,143,372

[45] Date of Patent: Sep. 1, 1992

[54] FOOTBALL TRAINING DEVICE

[75] Inventor: Thomas J. Wilson, Ames, Iowa

[73] Assignee: Power Performance, Inc., Ames, Iowa

[21] Appl. No.: 598,219

[22] Filed: Oct. 16, 1990

[51] Int. Cl.[5] ..... A63B 67/00

[52] U.S. Cl. ..... 273/55 R; 272/117; 272/130

[58] Field of Search ..... 273/55 R; 272/116, 120, 272/123, 132, 134, 135, 136, 137, 138, 144, 117, 130, 118

[56] References Cited

U.S. PATENT DOCUMENTS

| | | | |
|---|---|---|---|
| 3,116,062 | 12/1963 | Zinkin | 272/134 |
| 3,458,192 | 7/1969 | Trice, Jr. | 273/55 R |
| 3,637,210 | 1/1972 | Brantley | 273/55 R |
| 3,897,060 | 7/1975 | Jennings | 273/55 R |
| 4,067,571 | 1/1978 | Rogers | 273/55 R |
| 4,087,089 | 5/1978 | Forrest | 273/55 R |
| 4,140,315 | 2/1979 | Page, Jr. | 273/55 R |
| 4,186,922 | 2/1980 | Ketchum | 273/55 R |
| 4,511,137 | 4/1985 | Jones | 272/134 |
| 4,546,968 | 10/1985 | Silberman | 272/117 |
| 4,598,907 | 7/1986 | Ross | 272/117 |
| 4,627,614 | 12/1986 | Angeli | 272/117 |
| 4,635,929 | 1/1987 | Shustack | 272/76 |
| 4,653,746 | 3/1987 | Brimier | 273/55 R |
| 4,688,792 | 8/1987 | Rivkin | 273/55 R |
| 4,720,103 | 1/1988 | Palladino, Jr. | 273/55 R |
| 4,807,871 | 2/1989 | Bryson | 272/134 |
| 4,828,252 | 5/1989 | Bowen et al. | 272/117 |

*Primary Examiner*—Theatrice Brown

*Attorney, Agent, or Firm*—Zarley, McKee, Thomte, Voorhees & Sease

[57] ABSTRACT

A pair of oppositely disposed A-frames support a pivot arm on which a spring cushioned pad is pivoted at the lower end of the pivot arm. Free weights are selectively placed on the pivot arm to provide the desired resistance. The pad on the arm is positioned at a height requiring the player to initially crouch to gain maximum mechanical advantage when performing the exercise of moving forwardly and upwardly as required by the arcuate path of travel of the pivot arm. The device is free of equipment encumbrances on either side or on the opposite side of the pivot arm from the player.

20 Claims, 2 Drawing Sheets

FOOTBALL TRAINING DEVICE

BACKGROUND OF THE INVENTION

An exercise device is needed for football players and in particular linemen to practice proper technique when performing at their position during competition. The technique includes the players starting out in an initial crouched position and moving forwardly into the opposing player while pushing upwardly and forwardly and concluding the exercise with separation when the player has been raised to a standing position. The exercise device should force the player to duplicate the preferred techniques for purpose of maximizing the benefits of the exercise.

There are numerous prior art devices with which football players may perform different exercises. One of which is disclosed in U.S. Pat. No. 4,720,103 wherein an upwardly sloping track is provided on which a carriage moves. The carriage is connected to a pulley system for imparting resistance to the movement of the carriage along the track. This represents a very complicated structure which limits the players ability to simulate actual playing conditions. The structure is confining and limits footwork exercises prior to contact with the resistance device and limits player movement at the end of the resistance exercise due to the equipment located directly in line with the players forward movement.

SUMMARY OF THE INVENTION

The football training device of this invention includes a pair of spaced apart A-frames interconnected by an overhead bar from which a pivot arm extends downwardly and in turn carries a spring-mounted pad at its lower end. The player in a crouched position moves forwardly with outstreched arms and hits the pad with his hands and continues moving forwardly and upwardly while gradually standing up at separation from the pad which simulates separation from an opposing player. The pad is hinged at the top to the pivot arm and spring loaded at the bottom thereby avoiding risk to the players hand and wrist on impact with the pad. The pivoting of the pivot arm forces the player to use proper technique to gain maximum mechanical advantage. The movement of the pad through an arc due to the pivotal motion of the pivot arm forces the player to practice the proper technique of starting low and finishing high. The frame is attached to a platform on which the player stands and performs preliminary footwork drills. The player's own weight holds the frame in a stable position throughout the exercise. A dampener in the form of a pad of hydraulic cylinders is provided for controlling the return of the pivot arm to the lowered down position thereby allowing the player to move freely at completion of the exercise by executing a hip roll without fear of the pivot arm swinging back into him. The area on the opposite side of the pivot arm from the player is unobstructed allowing the player to move through and below the pivot arm if desired. A bracket with a post is provided on the pivot arm for holding the desired number of weights to provide the desired resistance.

DESCRIPTION OF THE PREFERRED EMBODIMENT

Figure 1:
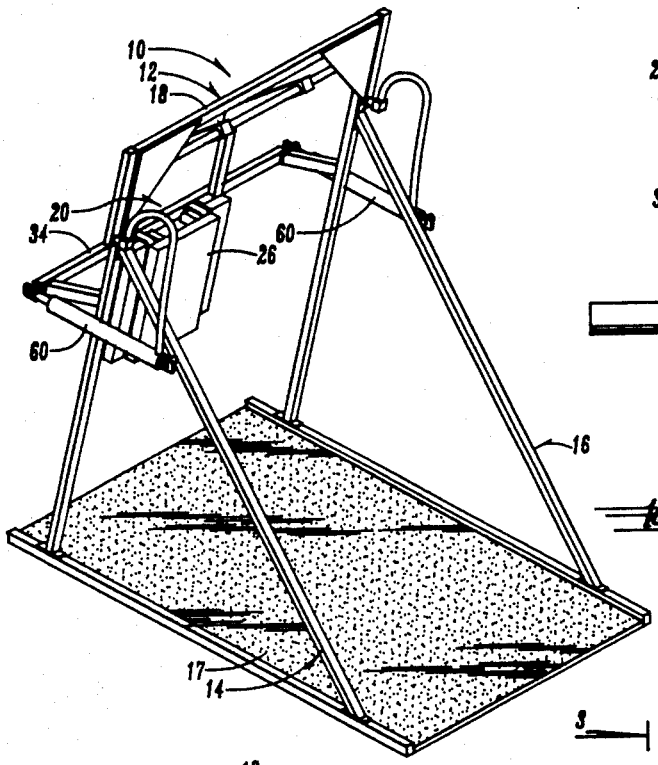
FIG. 1 is a perspective view of the football training device from the rear as viewed by the person using the device.

The football training device of this invention is referred to generally in FIG. 1 by the reference numeral 10 and includes a frame 12 having a pair of oppositely disposed side A-frames 14 and 16 interconnected by a top cross bar 18. The A-frames 14 and 16 are connected to a platform 17 covered with an artificial grass material.

A pivot arm 20 is carried on a bar 22 and includes a pair of spaced apart arm members 24 which carry at their lower ends a pad assembly 26.

Figure 4:
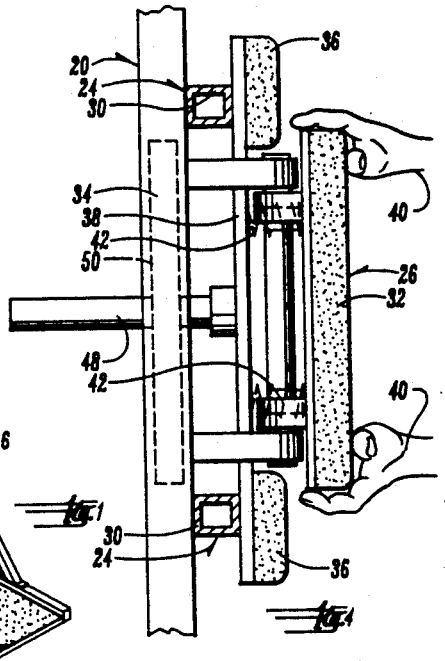
FIG. 4 is a fragmentary cross-sectional view taken along line 4—4 in FIG. 3.
Figure 3:
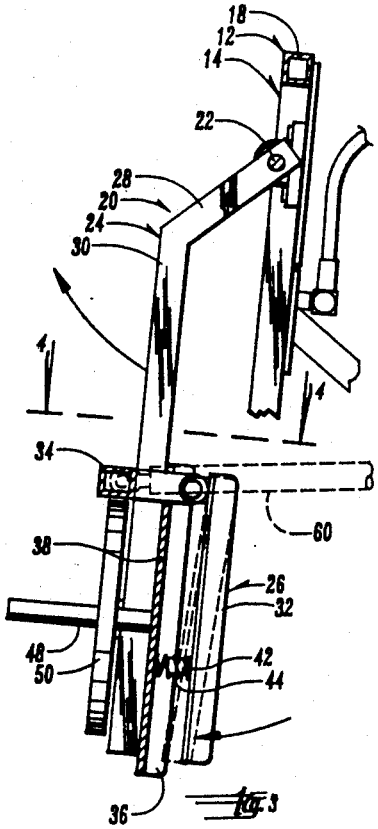
FIG. 3 is a fragmentary cross-sectional view taken along line 3—3 in FIG. 2.
Figure 2:
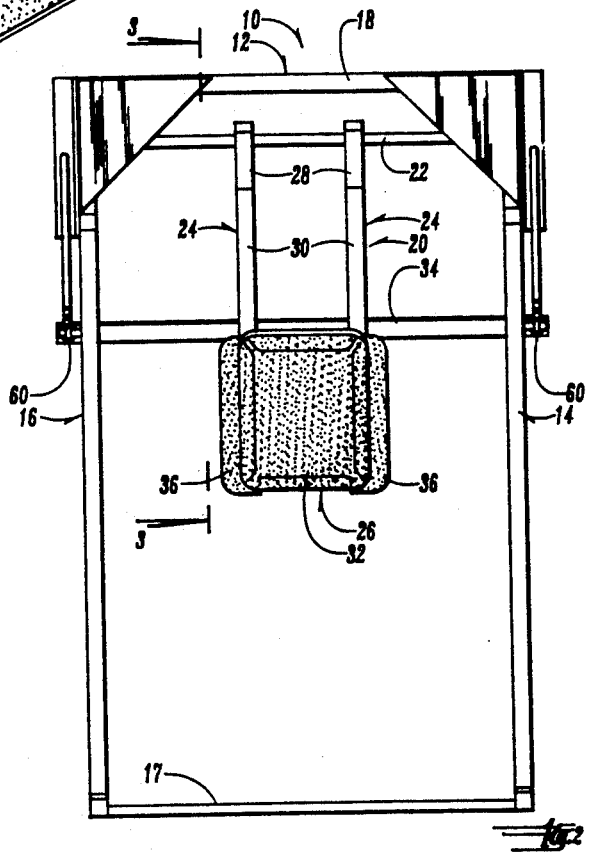
FIG. 2 is an elevational view taken from the right side of the device in FIG. 1.

The arms 24 have upper portions 28 pivotally connected to the bar 22 and extend outwardly and downwardly therefrom and merge into downwardly extending portions 30 which carry the pad assembly 26. The pad assembly 26 includes a center pad 32 pivoted at its upper end to the arms 24 and a lower cross bar 34. Oppositely disposed side pad members 36 are mounted on a plate 38 secured to the arms 24. The center pad 32 is spaced from the oppositely disposed side pad members 36 as seen in FIGS. 3 and 4 to accommodate the user's hands 40. The pivotal movement of the center pad 32 relative to the plate 38 is limited by a spring 42 mounted on a stop pin 44 such that the initial force on the pad 32 is resisted by the spring 42 and continued pressure applied causes the pad to bottom out against the pin 44.

A weight bracket pin 48 is mounted on the plate 38 opposite the pad assembly 26 and is designed to carry any desired number of free weights 50.

Figure 6:
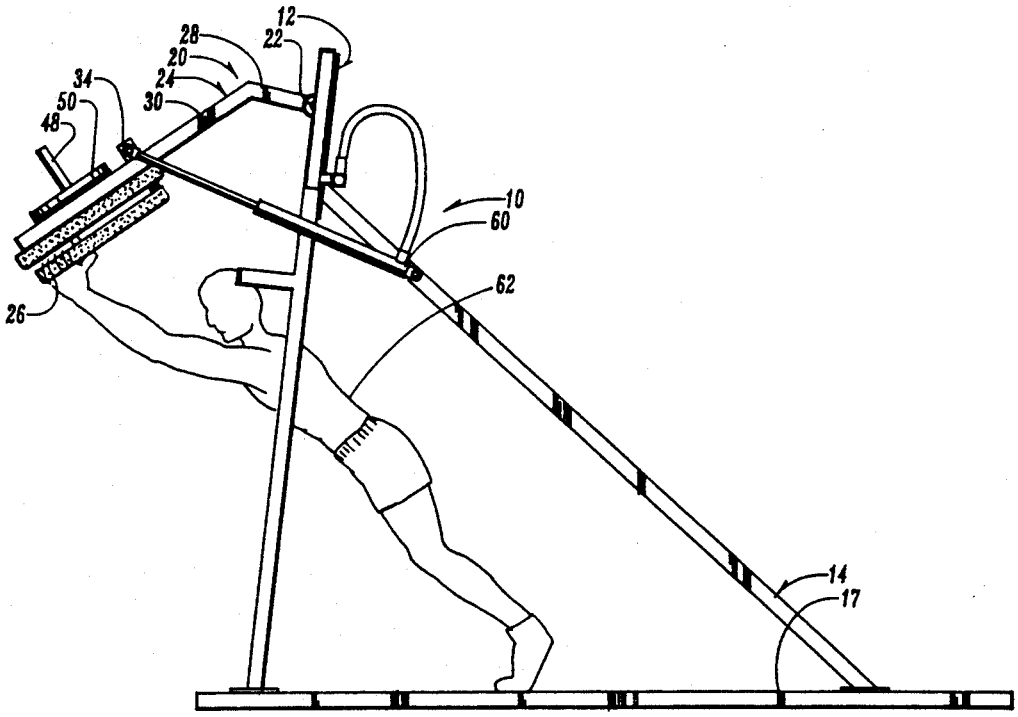
FIG. 6 is a view similar to FIG. 5 showing the player having pivoted the pivot arm to a raised position with the player's body fully extended.

A dampening system is provided for controlling the return pivotal movement of the pivot arm 20 such that it does not crash into the player at the completion of the exercise as seen in FIG. 6. The dampening system includes oppositely disposed hydraulic cylinders 60 connected between the A-frames 14 and 16 and the lower bar 34 connected to the pivot arms 24.

Figure 5:
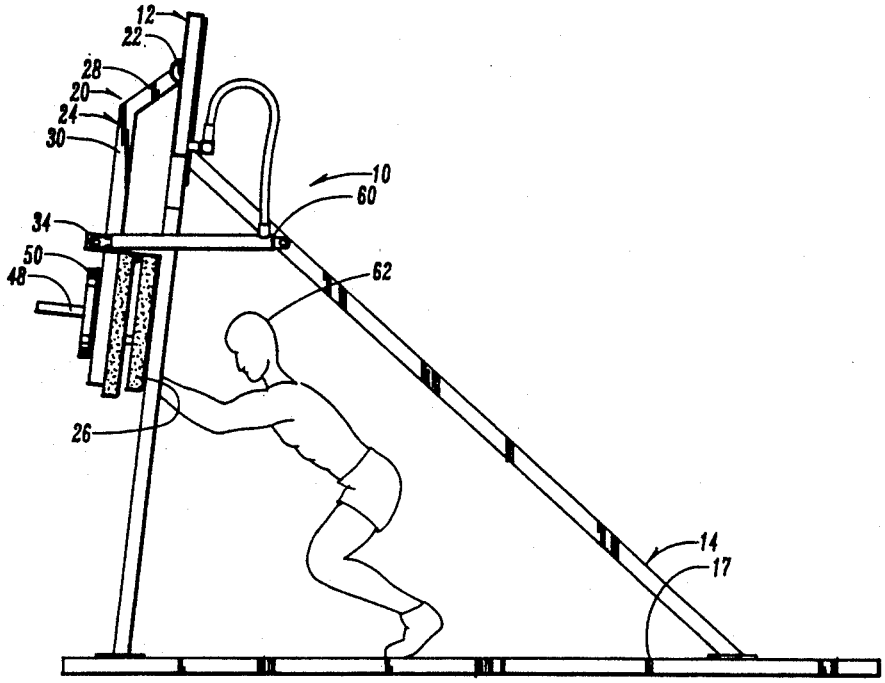
FIG. 5 is a side elevational view showing the football player in an initial crouched position with hands on the pad ready to begin the exercise.

Thus it is seen in use that the player 62 starts out in a crouched position as seen in FIG. 5 and moves forwardly into the pad with outstretched arms and hits the pad 32 with his hands. He then continues moving forwardly and at the same time moves upwardly finishing the exercise in the fully extended position of FIG. 6. He is now free to roll his hips from one side or the other without the pivot arm crashing back upon him as it is controlled in its return movement to the lowered position of FIG. 5 by the hydraulic cylinder 60. The use of a spring loaded pivot pad minimizes risk of injury to the wrists and hands. The player will be forced during the exercise to use the correct technique since maximum mechanical advantage is provided by the player placing his hands at the lower end of the pivot arm assembly 20 as seen in FIGS. 5 and 6. He must move into a crouched position to do this. He is also forced to complete the exercise in a raised fully extended position due to the arc through which the pivot arm moves wherein the center pad 32 moves higher as the player moves forwardly thereby causing the player to fully extend his body by standing up and moving forward. The exercise is simple in design and free of equipment on either side or on the opposite side of the pivot arm from the player such that the player is free to practice preliminary footwork and to complete the exercise in a natural manner similar to that which exists during competition.

I claim:

1. A football training device comprising, a frame having a pivot arm extending downwardly over an exercise area, said arm having a lower free end, a pad positioned on the lower free end of said pivot arm, said pivot arm positioned to pivot through an arc from a down position with said arm extending downwardly to a raised position in response to a person applying pressure to said pad, said pad on said lower free end of said pivot arm being at a height requiring a person to crouch upon making initial hand contact with said pad to have maximum mechanical advantage while pressing forwardly and upwardly through an exercise, and said pad being spring mounted on the lower end of said pivot arm to cushion a persons contact with said pad when exercising.

2. The structure of claim 1 wherein said frame is floor mounted.

3. The structure of claim 2 wherein said frame includes a floor platform connected thereto positioned in said exercise area.

4. The structure of claim 3 wherein said person exercising does so on said platform thereby holding said frame stationary as said pivot arm is moved to said raised position.

5. The structure of claim 2 wherein said frame includes oppositely disposed A-frames which support an overhead bar to which said pivot arm is connected.

6. The structure of claim 1 wherein a control means is connected to said pivot arm to control its downward pivoting to said down position upon completion of an exercise.

7. The structure of claim 4 wherein said control means is further defined as being a hydraulic means.

8. The structure of claim 1 and a weight bracket means is provided on said pivot arm whereby weights may be selectively carried on said arm to vary the resistance to pivoting from said down position to said raised position.

9. A football training device comprising:

a frame having a pivot arm extending downwardly over an exercise area, said arm having a lower free end, a pad positioned on the lower free end of said pivot arm, said pivot arm positioned to pivot through an arc from a down position with said arm extending downwardly to a raised position in response to a person applying pressure to said pad, said pad on said lower free end of said pivot arm being at a height requiring a person to crouch upon making initial hand contact with said pad to have maximum mechanical advantage while pressing forwardly and upwardly through an exercise, and said pad having upper and lower ends and being pivotally connected at its upper end to said pivot arm, and spring means being positioned between the lower end of said pad and said pivot arm to cushion a persons contact with said pad when exercising.

10. The structure of claim 9 wherein said frame is floor mounted.

11. The structure of claim 10 wherein said frame includes a floor platform connected thereto positioned in said exercise area.

12. The structure of claim 11 wherein said person exercising does so on said platform thereby holding said frame stationary as said pivot arm is moved to said raised position.

13. The structure of claim 10 wherein said frame includes oppositely disposed A-frames which support an overhead bar to which said pivot arm is connected.

14. The structure of claim 9 wherein a control means is connected to said pivot arm to control its downward pivoting to said down position upon completion of an exercise.

15. The structure of claim 14 wherein said control means is further defined as being a hydraulic means.

16. The structure of claim 9 and a weight bracket means is provided on said pivot arm whereby weights may be selectively carried on said arm to vary the resistance to pivoting from said down position to said raised position.

17. A football training device comprising, a frame having a pivot arm extending downwardly over an exercise area, said arm having a lower free end, a pad positioned on the lower free end of said pivot arm, said pivot arm positioned to pivot through an arc from a down position with said arm extending downwardly to a raised position in response to a person applying pressure to said pad, said pad on said lower free end of said pivot arm being at a height requiring a person to crouch upon making initial hand contact with said pad to have maximum mechanical advantage while pressing forwardly and upwardly through an exercise, and said pad including a center pad member with oppositely disposed side pad members, said side pad members being spaced rearwardly from the center pad to provide hand spaces for a person's hands on opposite sides of said center pad.

18. The structure of claim 17 wherein said center pad is spring mounted on said lower end of said pivot arm to cushion a persons contact with said pad when exercising.

19. The structure of claim 17 wherein said pad is spring mounted on the lower end of said pivot arm to cushion a persons contact with said pad when exercising.

20. The structure of claim 17 wherein said pad has upper and lower ends and is pivotally connected at its upper end to said pivot arm, and spring means is positioned between the lower end of said pad and said pivot arm to cushion a persons contact with said pad when exercising.

* * * * *